United States Patent [19]

Redford

[11] 4,149,597

[45] Apr. 17, 1979

[54] METHOD FOR GENERATING STEAM

[75] Inventor: David A. Redford, Ft. Saskatchewan, Canada

[73] Assignee: Texaco Exploration Canada Ltd., Canada

[21] Appl. No.: 864,994

[22] Filed: Dec. 27, 1977

[51] Int. Cl.[2] ..... E21B 43/24; F22B 1/04

[52] U.S. Cl. ..... 166/272; 166/266; 208/11 R; 208/126; 122/28

[58] Field of Search ..... 208/11 R, 126, 127; 166/272, 266, 267; 122/459, 28

[56] References Cited

U.S. PATENT DOCUMENTS

| | | | |
|---|---|---|---|
| 1,597,718 | 8/1926 | Bringhenti | 122/28 |
| 1,738,890 | 12/1929 | Goodrich | 122/28 X |
| 2,639,263 | 5/1953 | Leffer | 208/11 R X |
| 2,897,894 | 8/1959 | Draper et al. | 166/272 |
| 2,969,226 | 1/1961 | Huntington | 166/266X |
| 3,520,795 | 7/1970 | Schulman et al. | 208/11 R |
| 3,634,225 | 1/1972 | Garbett | 208/11 R |
| 3,880,237 | 4/1975 | Snavely, Jr. | 166/266 X |
| 3,881,550 | 5/1975 | Barry | 166/266 X |
| 4,003,797 | 1/1977 | Cheadle et al. | 208/11 R X |
| 4,007,786 | 2/1977 | Schlinger | 166/266 |

*Primary Examiner*—Stephen J. Novosad
*Attorney, Agent, or Firm*—Carl G. Ries; Thomas H. Whaley; Jack H. Park

[57] ABSTRACT

Disclosed is a method for generating steam from water containing high concentrations of particulate matter such as silt, clay, etc., without the need for filtering and otherwise treating the water prior to generation of steam therefrom, especially useful for use in a viscous oil recovery process. The method comprises introducing solid particulate materials such as coarse sand, etc., into a thermal cracking unit such as, for example, that is used in the Lurgi-Ruhrgas process. The solids are heated to a temperature of at least 1400° F., and on contacting the crude, cause cracking of the viscous crude into lighter molecular weight hydrocarbons and form a solid coke-like residue on the sand grain. The sand grains containing the coke residue are transported into a second chamber into which air is injected and the solid coke residue ignited. The carbon coke residue burns, raising the temperature of the sand or other granular solids. A portion of the hot solids are recycled into the thermal cracking unit, and another portion are transported to a steam generator unit into which dirty water, e.g., water containing high concentrations of suspended particulate matters such as sand, clay, silt, etc. is introduced. The rate of hot solids introduction and water injection into the steam generating unit are controlled so as to produce steam of the desired quality for use in a steam injection viscous oil recovery method.

7 Claims, 1 Drawing Figure

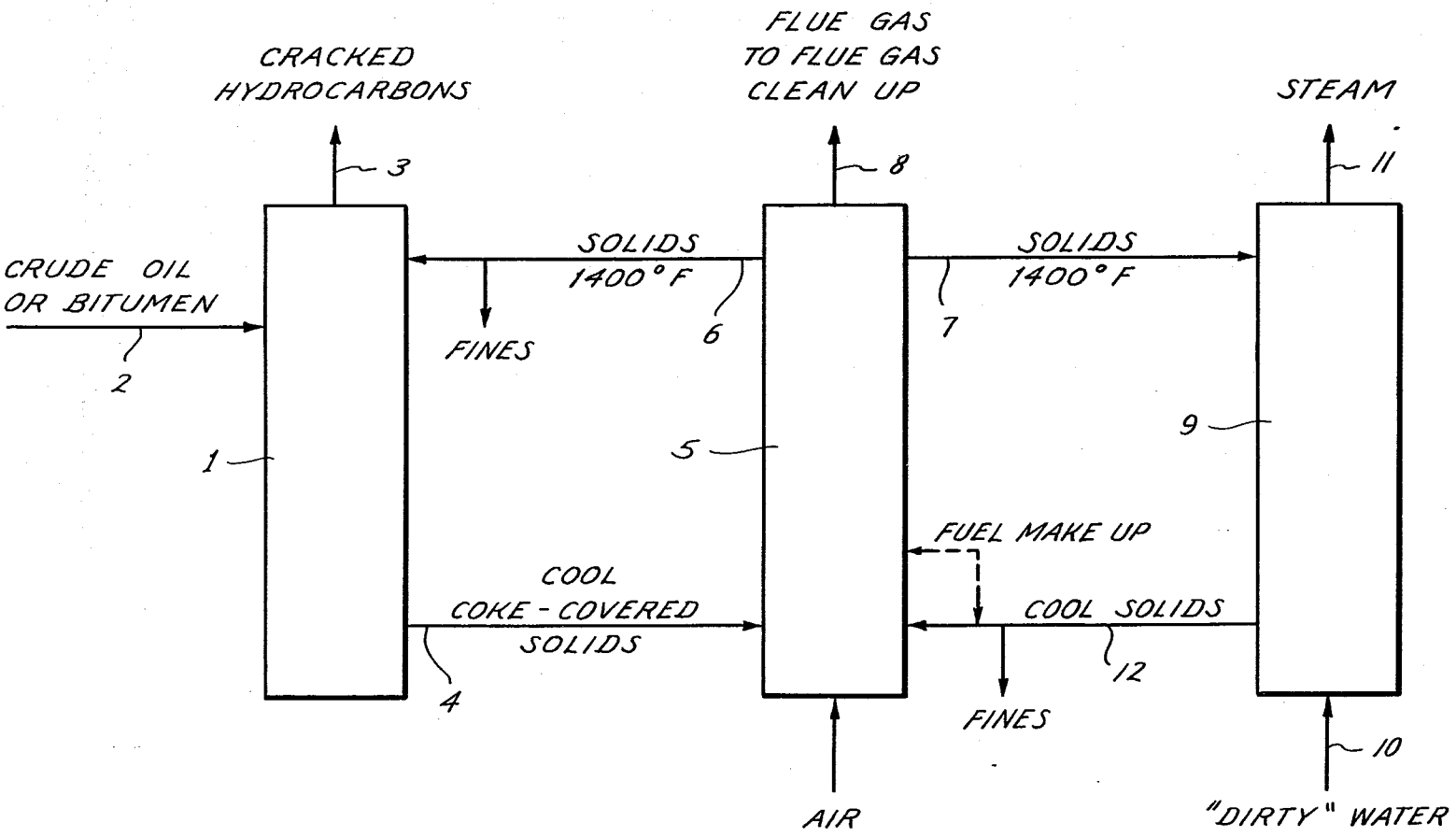
CRUDE OIL
OR BITUMEN
2
1
CRACKED
HYDROCARBONS
3
SOLIDS
1400°F
FINES
6
COOL
COKE-COVERED
SOLIDS
4
5
FLUE GAS
TO FLUE GAS
CLEAN UP
8
AIR
SOLIDS
1400°F
7
FUEL MAKE UP
COOL SOLIDS
12
FINES
9
STEAM
11
"DIRTY" WATER
10

METHOD FOR GENERATING STEAM

FIELD OF THE INVENTION

This invention relates to a method for generating steam from water without the need for treating the water to remove suspended and/or dissolved solids. More particularly, this invention concerns a method of generating steam wherein granulated or particulate matter such as sand which is coated with a solid fuel such as coke residue from a Lurgi-Ruhrgas process is burned to raise the temperature of the solids, and a portion of these solids are then introduced into a steam generating unit where the hot particles contact water, thereby generating steam. The process is especially useful in combination with steam injection viscous oil recovery processes.

BACKGROUND OF THE INVENTION

Petroleum is recoverable from subterranean formations in which it has accumulated only if certain essential conditions exist; namely, the formation must have adequate permeability or interconneted flow channels so a fluid will flow from one portion of the formation to the other if a pressure gradient is applied to the formation; the petroleum viscosity must be sufficiently low that it will move if flow channels exist and the pressure differential is applied to the fluid, and finally a source of energy to provide pressure differential for causing fluid movement in the formation must exist naturally or be supplied to the formation. When all three of these conditions co-exist naturally, so called primary recovery in which fluid movement to the surface under its own initiative without any type of formation treatment is possible. Supplemental recovery is necessary when any of these basic elements is missing or when drive energy has been depleted by primary recovery. Frequently it is necessary to apply corrective treatment in order to reduce the petroleum viscosity and simultaneously supply fluid drive energy.

The most extreme example of petroleum-containing formations which require a substantial amount of treatment to permit the recovery of petroleum therefrom are the so called bituminous sands or oil sand deposits. Extensive oil sand deposits are found in the western United States, in northern Alberta Canada, and in Venezuela, and lesser deposits are located in Europe and Asia. The Athabasca deposits in Alberta Canada are the most famous, and it is estimated that these deposits contain as much as 700 billion barrels of petroleum. Some production has been obtained from shallow deposits by strip mining, but most of the deposits are located at depths too great to permit strip mining by current technology. The fluid permeability of tar sand deposits in their initial state is quite low and the viscosity of the bituminous petroleum contained therein is in the range of millions of centipoise at formation temperatures. Accordingly, substantial treatment is necessary to reduce the viscosity of the bituminous petroleum contained in these oil sand deposits in order to accomplish substantial flow of petroleum through the formation to the wells completed therein, even if adequate pressure differential is applied between an injection well and the production well.

Several methods have been described in the literature for recovering bituminous petroleum from oil sand deposits. Most of these methods employ steam injection, either alone or in combination with emulsifying chemicals such as caustic solution, or in combination with hydrocarbons. While the technical feasibility of processes for recovering viscous bituminous petroleum from oil sand deposits involving steam injection has been demonstrated, none of the processes have been developed to a commercially viable level. Enormous quantities of steam are required to reduce the viscosity of bituminous petroleum to a level such that it will flow through the formation to the production well from which it can be pumped or lifted to the surface, and the fuel cost for generating steam, especially superheated steam, is very substantial for a number of reasons. The most desirable fuels for use in firing generators and boilers to generate steam for use in thermal in situ recovery techniques employing steam injection include natural gas and relatively low molecular weight fuel oils including diesel oil, and these materials are in short supply and have become quite expensive because of their desirability for use in residential and industrial heating and other purposes. Accordingly, there is a significant need for a method of generating steam for separating highly viscous petroleum including bituminous petroleum found in oil sand deposits using less expensive and less desirable fuels than natural gas and relatively low molecular weight liquid hydrocarbon fuels.

Another significant cost associated with the generation of steam suitable for use in steam injection is the cost of treating the vast quantities of water required for the generation of the steam. Water must be treated to remove suspended particulate matter such as silt, clay, etc. as well as dissolved salt, prior to introduction of feed water into a conventional steam generator or boiler. Failure to properly treat feed water prior to its use in generating steam can result in rapid buildup of scale and other deposits on the tubes found in conventional steam generation equipment, and concentration of dissolved materials in the liquid fraction of saturated steam such as is commonly utilized in steam injection processes. In many of the regions where viscous petroleum formations are found and where it would be desirable to apply steam injection techniques for stimulating production thereof, the most readily available and least expensive water supplies include water from rivers, lakes, or water produced from oil producing formations in connection with other oil producing operations, which are frequently very high in suspended particulate matter content and in dissolved solids content. Excessively costly treatment is required to use such feed water in conventional steam generating equipment. Accordingly, it can be appreciated that there is a significant need for a method for generating steam using relatively dirty water without the costly treatment processes as are ordinarily needed.

DESCRIPTION OF THE PRIOR ART

The Lurgi-Ruhrgas process is described in considerable detail in "Production of Synthetic Crude Oil from Oil Sands by Application of the Lurgi-Ruhrgas Process" by R. W. Rammler, Canadian Journal of Chemical Engineering, Vol. 48, October, 1970. Other pertinent references are cited in the above mentioned references.

Canadian Pat. No. 652,237, A. H. Faulk, Nov. 13, 1962, describes a method of recovering volatile substances from particulate solids.

Another general discussion of the Lurgi-Ruhrgas process is contained in "The Retorting of Coal, Oil, Shale and Tar Sand by Means of circulated fine grain heat carriers in the preliminary state in the production of synthetic crude oil," by R. W. Rammler, Quarterly of the Colorado school of mines.

A variation of the Lurgi-Ruhrgas process is described in Canadian Pat. No. 469,771, "Process for Recovery of Hydrocarbon Oils and Apparatus Therefor", W. L. Thompson, Nov. 28, 1950.

SUMMARY OF THE INVENTION

My invention concerns a method for generating steam, including superheated steam, especially suitable for use in connection with viscous oil recovery methods involving steam injection, which permits use of dirty water or water containing such large quantities of suspended and/or dissolved solid materials that the water could not otherwise be utilized for steam generation purposes without extensive water treatment. By using "dirty" water, much more efficient water management is possible in the area in which the process is employed. The process involves an extension of the Lurgi-Ruhrgas process in which viscous crude oil or bitumen is introduced into a thermal cracking unit and brought into contact with hot granulated solids such as sand at a temperature of at least 1400° F., which raises the temperature of the crude oil or bitumen sufficient to cause thermal cracking thereof. The cracked hydrocarbons which may include a small amount of gaseous components are recovered from the reactor, leaving the granular solids having deposited on the surface of the granular solids a layer of carbonaceous or coke-like substance. The coke-covered granular solids are then introduced into a second reactor, and air is introduced and the temperature raised sufficiently to cause the coke residue on the surface to burn, which raises the temperature of the granular solids. A portion of the hot granular solids are recycled into the thermal cracker, and a portion are transported into a third reactor. Dirty water, such as produced water or water from a lake or river containing substantial quantities of suspended particulate matter and/or dissolved solids are introduced into the third reactor chamber and brought into contact with the hot solid granular material. The temperature of the dirty water is raised to a value well in excess of the boiling point of water at the pressure within the steam generator unit upon contacting the hot granulated solid material, and substantially all of the liquid water is flashed to steam as a consequence thereof. The suspended particulate matter and the solids originally dissolved in the feed water remain mixed with the granular material. The solids may be allowed to remain with the granular material, or they may be separated therefrom by blowing or passing the total stream containing all of the granular material through a cyclone separator such as is well known in the art. The relatively cool solids are then recycled back to the second unit, to comingle with the coke-covered solids in the combustion unit. By means of the foregoing process, the fuel utilized for generation of steam is the solid coke residue coating on the solid granular heat carrier material, which is the least valuable portion of the hydrocarbons obtainable from the crude oil. Furthermore, the steam is generated by use of feed water, usually water produced from a petroleum formation, which requires little or no pretreatment for purpose of removing suspended or dissolved solid matter. Furthermore, any low molecular weight hydrocarbon or other organic matter present in the feed water is vaporized and mixed with the steam generated, which is an additional benefit for oil recovery purposes since the presence of hydrocarbons comingled with steam improves viscous oil recovery efficiency.

BRIEF DESCRIPTION OF THE DRAWING

The attached drawing illustrates a process for the practice of my invention in which crude oil or bitumen is passed into a sand cracker where the oil is thermally cracked on contacting hot, granular solids. Coke-covered solids are formed and are burned to produce hot solids for operation of the sand cracker and further for the purpose of generating steam to be utilized in a thermal recovery operation.

DESCRIPTION OF THE PREFERRED EMBODIMENTS

The process of my invention may best be understood by referring to the attached drawing, in which a specific example of a typical thermal cracking unit 1 is shown. Crude oil or bitumen is fed into the unit by line 2, which may connect directly to production gathering equipment in the instance of utilizing the process described herein at the site where viscous oil is being produced. This is a particularly preferred method of applying the method of the process of my invention, since some cracking of very viscous petroleum such as that found in oil sand deposits is necessary to permit transportation of the produced hydrocarbons to a refinery, since the produced crude is otherwise too viscous to be pumped through a pipeline at ambient temperature. The feed into reactor 1 may be substantially pure crude oil or petroleum, or it may be the whole tar sand material if the process in which the crude oil is being obtained is one which results in recovering the whole tar sand material. Ordinarily the process is more efficient if at least a portion of the sand normally present in tar sand material is removed, so the feed is at least petroleum-enriched tar sand material since otherwise excessive quantities of inert sand will be heated over that which can be utilized for the Lurgi-Ruhrgas or sand cracking process and the steam generation process of my invention.

In the specific illustrative embodiment shown in the drawing and described below, the unit size is based on a bituminous petroleum production rate of 350 barrels per day, and steam injection rate of 700 barrels per day.

Reactor 1 comprises a pressurized vessel which permits the recycled hot solids to thoroughly contact viscous crude oil or bitumen or in reactor 1. Mixing facilities are ordinarily quite helpful for this process, or a fluidized bed reactor may be utilized. The temperature is controlled by controlling the temperature of the solids being introduced, as well as by varying the ratio of recycled hot solids to crude oil or bitumen being introduced. Ordinarily the temperature of the cracking process occurring in the reactor 1 should be maintained in excess of 450° C. (842° F.).

The cracked hydrocarbons are removed from reactor 1 via line 3, and may be fed directly to a refinery or to a gathering unit for transportation via pipeline to a remotely located refinery. The effluent from reactor 1 will ordinarily be liquid in nature, especially under the optimum operating conditions of the present invention, although a small amount of gas, principally methane and hydrogen, may also be produced. This can be separated and utilized for supplemental steam generation purposes on site, or left dissolved in the crude at the pressure at which the liquids are transported in the pipeline. The presence of low molecular weight components dissolved in crude will ordinarily reduce the crude viscosity slightly, and so such presence is generally beneficial.

In the sand cracking process which occurs in reactor 1, from 10 to 30 percent of the total hydrocarbon content introduced into the reactor 1 is converted to a solid coke-like substance which coats the granular material. The coke-covered sand is transported from reactor 1 via line 4 into reactor 5. In reactor 5, the relatively cool, coke covered sand or other granular solids are mixed with air and ignited to accomplish combustion of the hydrocarbon coke materials present on the sane grains. As a result of combustion of the solid carbon residue on the granular solids in reactor 5, the temperature of these granular solids is increased appreciably. The temperatures can be controlled by regulating the rate at which coke-covered solids ar introduced into reactor 5 and by regulating the rate of injecting air thereinto. It is desirable that the temperature of the solids exiting from reactor 5 by lines 6 and 7 be at least 760° C. (1400° F.). The hot solids may be transported by means of gas flow or by mechanical means including screw conveyors, or a simple gravity feed arrangement can be utilized. Line 6 recycles the hot solids back to the thermal cracking unit 1.

The gaseous products of combustion, which may include some volatized hydrocarbons from the coke which are not consumed in the combustion reaction, are removed from reactor 5 by means of flue line 8, and the gaseous effluent stream may be subjected to conventional flue gas cleanup treatment prior to being discharged into the atmosphere.

The hot granular solids, e.g. for example coarse sand at a temperature of 1400° F. (760° C.), are transported by line 7 into steam generation unit 9, where they are mixed with dirty feed water which is introduced into the generation unit 9 by means of line 10. Ordinarily the feed water will be derived mainly from water produced from the oil formation, which contains excessive amounts of suspended particles, such as clay or silt and dissolved minerals to permit use thereof in ordinary steam generating equipment without extensive treatment. No cleanup or treatment of the feed water is ordinarily required in this instance, since any suspended particulate solid matter or dissolved material present in the feed water will be deposited on or mixed with the solids that are removed from steam generator unit 9. The heat present in the granular solid material being introduced into reactor 9 is transferred to the water, and results in generation of steam which can be sent by line 11 to the steam injection manifold, where it is injected into the viscous oil formation for the purpose of further stimulating production of viscous petroleum in the formation. The quantity of steam is regulated by regulating the feed water rate and the rate of introduction of hot granular solid into the reactor, and the desired quality of steam is obtained by regulating the ratio of the feed rate of solid granular solids to feed water flow rate. One particularly attractive feature of my invention is that superheated steam, e.g. 500 psig, 1200° F. in the example, may be generated without additional equipment or use of additional fuel.

The solids are removed from the steam generator unit 9 by line 12, and if desired, the fine solids, particularly those removed from the feed water, may be removed by blowing, cyclone separation, or other techniques such as are known in the art of solids classification.

The solids are recycled into combustion unit 5. If needed, supplemental fuel may be added to reactor 5 in order to maintain the temperature of the solids exiting therefrom at the desired level. This may be introduced in the form of a spray or jet directly into the reactor, although a preferred method involves coating the recycled cool solids being returned from steam generator unit 9 to combustion unit 5 by means of line 12, so the supplemental fuels thoroughly coats the surface of the recycled solids and insures uniform heating of the solid granular material in combustion unit 5.

Steam generated by means of this process may be transported via line 11 to suitable injection means and injected into the formation along or in combination with any other substance. One especially preferred oil recovery process comprises injecting steam and an inert gas into the formation, and so a particularly desirable embodiment of the present invention comprises combining at least a portion of the flue gas exiting from combustion unit 5 via line 8 with steam generated in unit 9, so a mixture of steam and flue gas is injected into the formation. The presence of flue gas helps maintain a gas saturation in the formation which promotes oil recovery by avoiding formation of occluding blockages in the formation. Furthermore, carbon dioxide is a major constituent of the flue gas, and since carbon dioxide dissolves in and reduces the viscosity of petroleum, the presence of carbon dioxide in the injected gaseous mixture is especially beneficial.

FIELD EXAMPLE

For the purpose of more fully illustrating the preferred embodiment of the process of my invention, the following field example is disclosed. This is offered for the purpose of ensuring completeness of the disclosure, however, it is not intended to be in any way limitative or restrictive of the process of my invention.

A tar sand deposit is located under 650 feet of overburden, and the thickness of the tar sand deposit is 110 feet. A pilot field project comprising injecting a mixture of steam and five percent naphtha hydrocarbons is applied to the formation. An injection well and a production well are drilled into and completed throughout the full thickness of the formation, the wells being 150 feed apart. Eighty percent quality steam is injected into the formation after previous treatment to insure fluid transmissibility through the formation has been completed. Approximately five percent naphtha is mixed with the steam for the purpose of further stimulating viscous oil recovery, and the total fluid injection rate is approximately 700 barrels per day.

After approximately 30 days, the thermal front has arrived sufficiently close to the production well that production of viscous petroleum begins, and this production of viscous petroleum is transported to a 35 cubic foot Lurgi-Ruhrgas thermal cracker, also referred to as a sand cracker. Since the fluid being produced from the formation is a complex mixture of water and oil, separation of the produced fluid is first accomplished by conventional demulsification techniques and essentially pure bitumen is fed into the sand cracker unit. By maintaining the temperature of the produced bitumen above approximately 185° F. by steam tracing the flow lines, the material remains sufficiently fluid that it will flow readily into the sand cracker.

The heat transfer medium utilized in this process is coarse sand having a particle size of from about 8 to about 12 mesh. At startup, diesel fuel is injected into a combustion unit for the purpose of raising the temperature of the coarse sand to approximately 1400° F. This heated sand is introduced into the sand cracker unit at a rate of about 25,000 pounds per hour. The rate of introduction of bitumen into this unit is about 5,000 pounds per hour. By maintaining the ratio of bitumen and hot sand flow into the sand cracker at about this level, the mixture remains at a temperature of about 475° C. (887° F.), which is a highly desirable operating range for this purpose. Thermal cracking of the bituminous petroleum occurs, with approximately one percent of the crude bitumen being coverted to gaseous components, and approximately 79 percent being converted to liquid hydrocarbons of substantially reduced molecular weight and viscosity as compared to the crude bitumen feed. Approximately 20 percent of the feed is converted to a solid carbonaceous coke material, substantially all of which is deposited on the surfaces of the coarse sand such that the granular material removed from the bottom of the sand cracker unit is coke-covered sand grains which can be readily transported by screw conveyor into the combustion chamber. A 130 cubic foot combustion chamber is utilized, with the coke covered solids being introduced at about the mid point of the reactor vessel and air being introduced into the bottom, so intimate contact between air and the coke covered sand grains is accomplished. A gas burner initiates combustion, but thereafter, it is not needed since the reaction is self-sustaining. By regulating the air flow at a value of about 152,000 standard cubic feet per hour, substantially all of the coke present on the sand grains is burned and the solid granular material is removed from the combustion unit at a temperature of about 760° C. (1400° F.), which is a preferred temperature for operating both the sand cracker and the steam generator according to the process of my invention. Approximately 15 million BTU per hour are generated in the combustion chamber. Flue gases are filtered to remove fine suspended particulate matter. Approximately 25,000 pounds per hour, or 29 percent of the total solids fed into the combustion unit go to the sand cracker, with the remaining 61,000 pounds per hour, or 71 percent, going to the steam generator unit.

Water which was originally separated from the produced fluid is utilized as the principal source of feed water, with additional makeup water being taken from a nearby lake. Both sources of water have substantial amounts of fine particulate matter suspended therein, and further contain approximately 90,000 parts million total dissolved solids, which includes both sodium chloride and some divalent ions, principally calcium and magnesium. No treatment of the feed water is necessary, which is a particular feature of the process of my invention. The rate at which the feed water is introduced into the steam generator is determined by monitoring the temperature of the steam generated, it being desired that steam at a temperature of about 470° F. and a pressure of about 500 psi be used in the ongoing steam injection process. The flow rate of feed water to achieve this steam quality averages about 10,000 pounds per hour (700 barrels per day). Cool solids are removed from the bottom of the steam generator unit and recycled into the combustion unit for continuing use in the process of my invention.

Steam generated in the above process is combined with both the hot flue gas from the combustion reactor and the gaseous effluent from the sand cracker, and injected into the viscous oil formation for further stimulation of viscous oil production. The overall process is in balance with no requirements for additional fuel.

While the process of my invention has been described in terms of a number of illustrative embodiments, it is not so limited since many variations thereof will be apparent to persons skilled in the art of thermal methods for recovering viscous oil without departing from the spirit of my invention. It is my desire and intention that my invention be limited and restricted only by those limitations and restrictions appearing in the claims appended hereinafter below.

I claim:

1. In a method of treating viscous crude oil by thermal sand cracking comprising contacting the viscous crude oil with hot granular heat transfer solids in a sand-cracking vessel, the temperature of the solids being at least 1400° F. (746° C.), the ratio of the flow rate of crude oil to bitumen being regulated to produce a mixture whose temperature is at least 450° C. (842° F.), whereby the crude is thermally cracked to produce lower molecular weight hydrocarbons and a solid hydrocarbon coke which adheres to the surface of the granular heat transfer solids; recovering the coke-covered granular heat transfer solids and introducing them into a second vessel, simultaneously introducing air into the second vessel; igniting the coke to raise the temperature of the granular heat transfer solids, removing a portion of the hot solids and recycling them into the sand cracker unit, wherein the improvement for generating steam utilizing untreated feed water containing suspended and/or dissolved solids comprises:

(a) introducing another portion of the hot granular heat transfer solids into a contacting vessel;
(b) introducing feed water containing suspended and/or dissolved solids into the contacting vessel, so the feed water and hot granular heat transfer solids comingle, thereby converting at least a portion of the feed water into steam;
(c) recovering steam from the contacting vessel; and
(d) removing solids including the granular heat transfer solids and solids removed from the feed water from the contacting vessel.

2. A method as recited in claim 1 comprising the additional steps of separating the solids recovered from the contacting vessel into granular heat transfer solids and fine solids recovered from the feed water, and recycling the granular heat transfer solids into said second vessel.

3. A method of recovering viscous petroleum including bitumen from a subterranean, permeable, viscous petroleum-containing formation including a tar sand deposit, said formation being penetrated by at least one injection well and by at least one production well, both wells being in fluid communication with the formation, comprising:

(a) recovering viscous petroleum from the formation;
(b) transporting the viscous petroleum into a thermal cracking vessel;
(c) introducing hot, granular heat transfer solids into the thermal vessel, the temperature of the granular solids being at least 1400° F. (746° C.);
(d) controlling the flow rate of granular heat transfer solids to cause the mixture of petroleum and solids to have a temperature in the range of from 359° C.

(700° F.) to 524° C. (1000° F.), thereby cracking at least a portion of the viscous petroleum feed to produce a first fraction comprising liquid hydrocarbons having molecular weight substantially less than the molecular weight of the viscous petroleum feed, a second gaseous fraction, and a third solid hydrocarbon coke at least a portion of which adheres to the surface of the granular, heat transfer solids;

(e) recovering the first and second cracked fractions from the thermal cracking unit;

(f) recovering the coke-coated granular heat transfer solids and transporting them to a combustion unit;

(g) contacting the coke coated granular heat transfer solids with air and igniting the coke to cause combustion thereof, thereby raising the temperature of the granular solids to at least 635° C. (1200° F.), and producing flue gas;

(h) recovering a first portion of the hot solids from the combustion unit and introducing them into the thermal cracking unit;

(i) recovering a second portion of the hot granular heat transfer solids from the combustion unit and introducing them in a steam generating unit;

(j) introducing feed water containing dissolved and/or suspended solids into the steam generating unit to contact the hot granular heat transfer solids;

(k) regulating the flow rate of feed water to convert a predetermined fraction of water to steam; and (l) recovering steam from the steam generating unit and injecting it into the viscous oil formation via the injection well.

4. A method as recited in claim 3 comprising the additional step of recovering the solids from the steam generating unit and recycling at least a portion thereof into the combustion unit.

5. A method as recited in claim 3 comprising the additional step of introducing the additional fuel into the combustion unit at a rate sufficient to maintain the temperature of the hot granular heat transfer solids being recovered therefrom at a value of at least 1400° F. (746° C.).

6. A method as recited in claim 3 comprising the additional steps of recovering at least a portion of the flue gas from the combustion unit, comingling said flue gas with steam being recovered from the steam generation unit, and injecting the mixture of steam and flue gas into the viscous petroleum-containing formation.

7. A method as recited in claim 3 comprising the additional steps of recovering at least a portion of the gaseous cracked hydrocarbons from the thermal cracking unit, comingling said gaseous hydrocarbons with said steam and injecting the mixture of steam and gaseous cracked hydrocarbons into the viscous petroleum formation via the injection well.

* * * * *